US006032695A

United States Patent [19]

Wellen et al.

[11] Patent Number: 6,032,695

[45] Date of Patent: Mar. 7, 2000

[54] RAIL PLUG

[75] Inventors: Gerald E. Wellen, North Branch; Robert J. Menne, Jr., Forest Lake, both of Minn.

[73] Assignee: Premier Marine, Inc., Wyoming, Minn.

[21] Appl. No.: 08/982,856

[22] Filed: Dec. 2, 1997

[51] Int. Cl.[7] ..... F16L 55/11

[52] U.S. Cl. ..... 138/89; 138/96 R; 215/320; 215/355; 220/DIG. 19; 220/801

[58] Field of Search ..... 138/89, 89.1–89.4; 215/355, 357, 320; 220/DIG. 19, DIG. 33, 796, 800–802

[56] References Cited

U.S. PATENT DOCUMENTS

| | | | |
|---|---|---|---|
| 2,669,370 | 2/1954 | Royall, Jr. | 215/355 |
| 2,886,203 | 5/1959 | Goll | 220/801 X |
| 3,269,581 | 8/1966 | Calder | 220/801 X |
| 3,349,532 | 10/1967 | Dudoff | 52/301 |
| 3,578,027 | 5/1971 | Zopfi | 138/89 |
| 3,977,654 | 8/1976 | Etherington et al. | 138/96 R |
| 5,327,942 | 7/1994 | Black | 138/89 |
| 5,499,737 | 3/1996 | Kraus | 220/307 X |

FOREIGN PATENT DOCUMENTS

| | | |
|---|---|---|
| 536228 | 11/1955 | Italy . |
| 1551855 | 9/1979 | United Kingdom . |

*Primary Examiner*—Patrick Brinson
*Attorney, Agent, or Firm*—Hugh D. Jaeger

[57] ABSTRACT

Plug for sealing or capping the open ends of tubular members, such as tubular rails or railing support members in boats. The plug has a cap from which extend upper, lower, right side and left side rearwardly projecting and connected planar panels. Each of the upper and lower planar panels and one of the side planar panels includes an outwardly protruding array of ramped teeth formed integrally therewith. The other side planar panel lacks an array of ramped teeth. The height of the teeth in each array increases incrementally from a minimum height remote from the cap to a maximum height adjacent to the cap. The ramping of the teeth allows for accommodational frictional engagement with various inside dimensions of tubular rails or railing support members to secure the plug tightly therewithin. A tapered indexing guide bar is located at the junction of the upper planar panel and the side planar panel which lacks an array of ramped teeth. The indexing guide bar serves as an alignment member to facilitate insertion of the plug into the open end of a rail or railing support member and also aids in retaining the plug once it is inserted.

16 Claims, 6 Drawing Sheets

RAIL PLUG

CROSS REFERENCES TO CO-PENDING APPLICATIONS

None.

BACKGROUND OF THE INVENTION

1. Field of the Invention

The present invention relates to a plug, and more particularly, pertains to a plug for capping or sealing an open end of a tubular rail or other tubular member. The invention has particular application in conjunction with tubular rails or railing support members on boats, but may be employed with tubular members found in any environment.

2. Description of the Prior Art

Prior art sealing plugs for closing the open ends of tubular members such as rails or railing support members have required a number of time-consuming installation steps, such as drilling of body holes in the sides of a rail or railing support members for subsequent insertion of screw, bolt or pin members through the body holes into the plug to retain the plug in the open end of the rail or railing support member. Other plugs have been secured into the open end of a rail or railing support member with adhesive, only to have the adhesive deteriorate with the passage of time and with thermal changes, thereby causing the plug to disengage itself from or become loose in the rail or railing support member. Some plugs have formed a close tolerance fit with the interior of a rail or railing support member, but with age or heating and cooling have shrunk and become loose in or disengaged themselves from the rail or railing support member. Clearly what is needed is a plug which can be installed in the open end of a rail or railing support member with a minimum of tools, or even with no tools, which does not require excessive installation labor, and which is not affected by heat, cold or adhesive or material deterioration. The present invention provides such a rail plug.

SUMMARY OF THE INVENTION

The general purpose of the present invention is to provide a plug to be used to cap or seal the open end of a tubular member such as a rail or railing support member used on a boat or in other environments. Sealing of the open ends of rails or railing support members is accomplished for a variety of reasons. Sealing of a rail or railing support member on a boat prevents one from inserting a finger into the open end of the rail or railing support member where injury could occur during boating activities. Exposed uncapped rails or railing support members present sharp edges or corners which could cause bodily harm if mistakenly contacted. Sealing also prevents insects from entering or building nests in the rail or railing support member. In the plug of the invention, a series of ramped teeth arrays are included on several adjacent sides of the plug for the purpose of frictional engagement with the interior of a rail or railing support member. The teeth are ramped or sloped to provide increasing frictional contact with various wall thickness rails or railing support members. As the plug is inserted further into the rail or railing support member, the teeth are brought into increasing flex contact with the inner surfaces of the rail or railing support member.

According to one embodiment of the present invention, there is provided a plug having a plurality of connected planar members extending perpendicularly from a planar surface of a cap member. These connected planar members include horizontally oriented and opposing upper and lower planar panels, vertically oriented and opposing left and right side planar panels extending between the horizontally oriented and opposing upper and lower planar panels, opposing arrays of ramped teeth located on the upper and lower surfaces of the horizontally oriented and opposing upper and lower planar panels and formed integrally therewith, and an array of ramped teeth located on the vertically oriented left side planar panel and formed integrally therewith. An indexing guide bar is located at the junction of the horizontally oriented upper planar panel and the vertically oriented right side planar panel. Together the horizontally oriented upper and lower planar panels, the vertically oriented left and right side planar panels, the indexing guide bar, and the integrally formed arrays of ramped teeth are inserted into the interior of a rail or railing support member and held therein by frictional engagement to fill and plug off the open end of the rail or railing support member.

One significant aspect and feature of the present invention is a one-piece plug which frictionally engages the open end of a rail or a railing support member, such as used in marine equipment.

Another significant aspect and feature of the present invention is the provision of opposing and adjacent arrays of ramped teeth on the plug which increasingly engage the interior of a rail or railing support member in frictional engagement.

Another significant aspect and feature of the present invention is a plug which remains in place even with temperature excursions.

Another significant aspect and feature of the present invention is a plug which can be installed with a minimum of tools, or preferably with no tools.

Another significant aspect and feature of the present invention is a plug whose installation is not hampered by the need for drilling of holes or installation of holding pins or screws.

Another significant aspect and feature of the present invention is a plug which is self-locating and self-aligning.

Another significant aspect and feature of the present invention is a plug which seals the open end of a rail or railing support member for prevention of bodily injury.

Another significant aspect and feature of the present invention is a plug which seals the open end of a rail or railing support member to prevent the entry of insects, debris, water, and other foreign objects.

Having thus described significant aspects and features of an embodiment of the present invention, it is the principal object of the present invention to provide a plug for capping or sealing the open end of a rail or railing support member.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
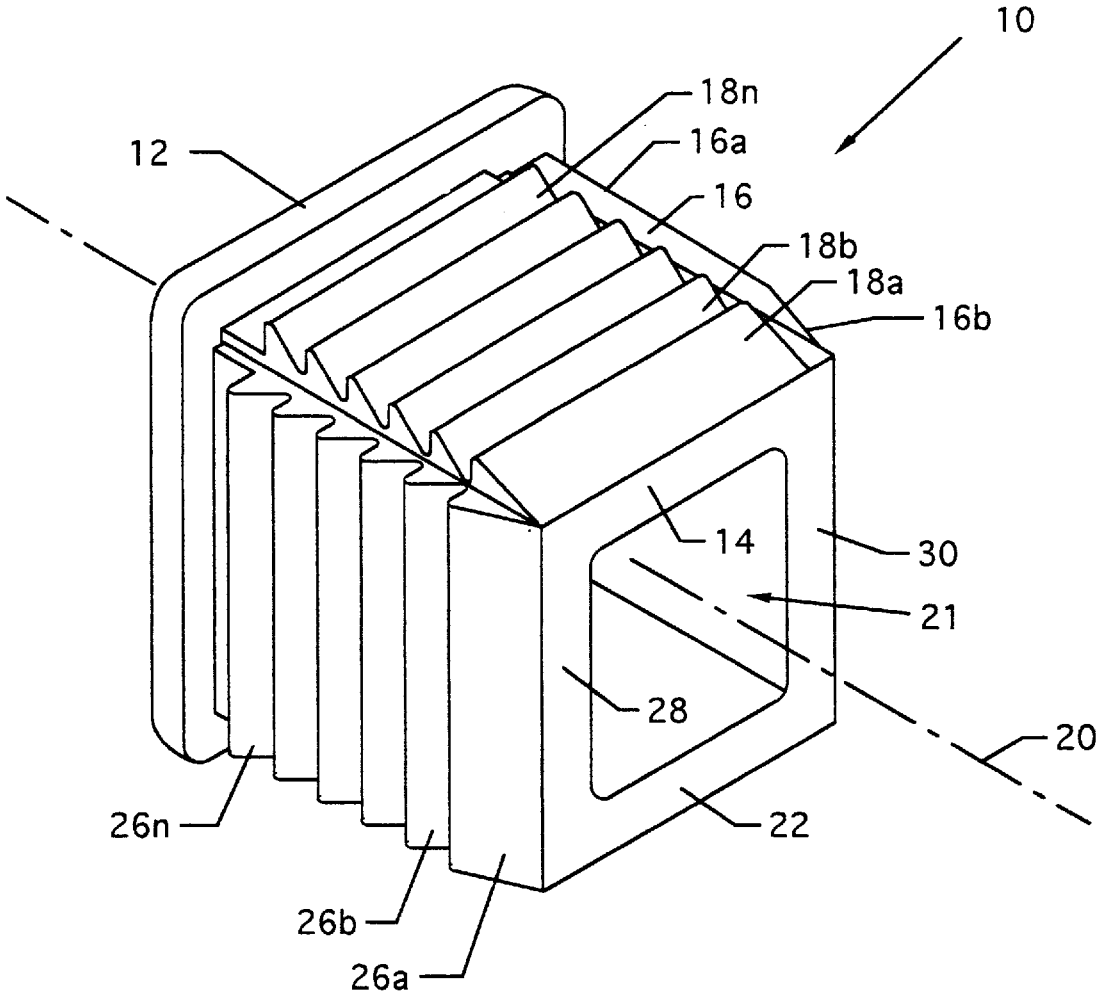
FIG. 1 illustrates an isometric view of a rail plug.
Figure 2:
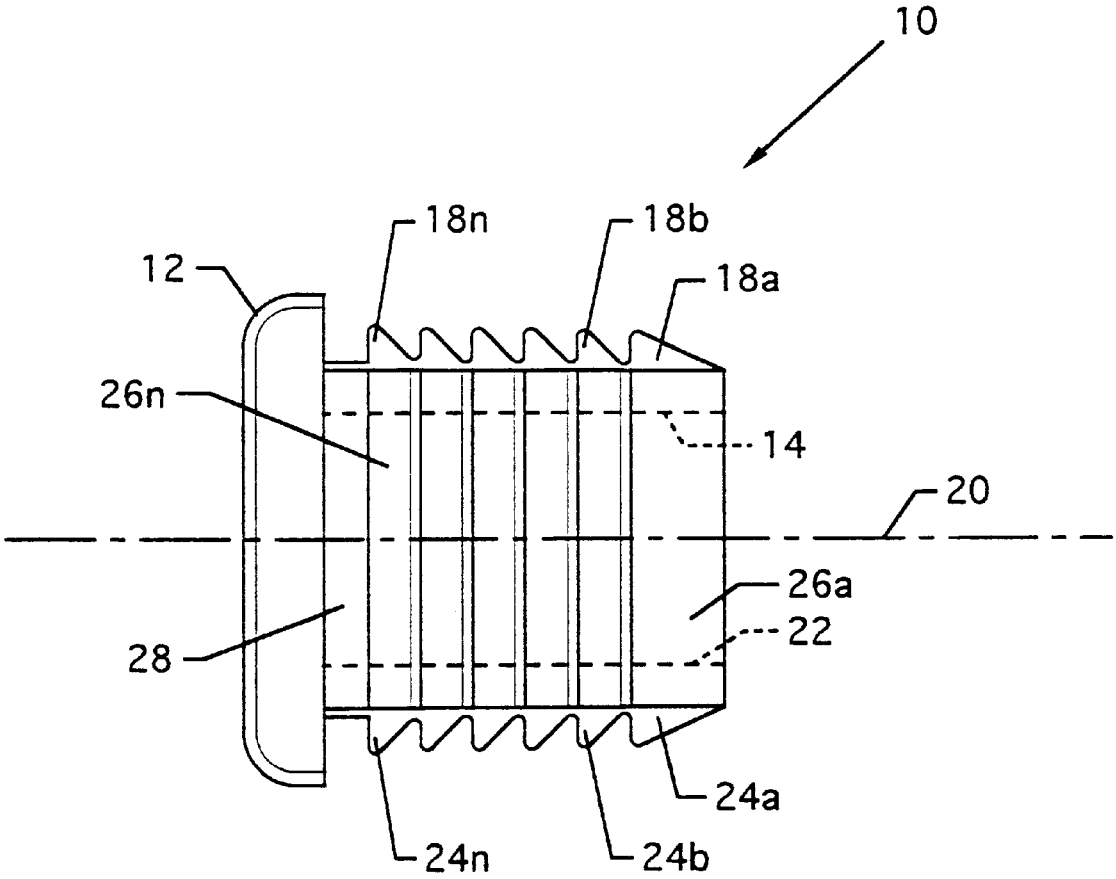
FIG. 2 illustrates a side view of the plug.
Figure 3:
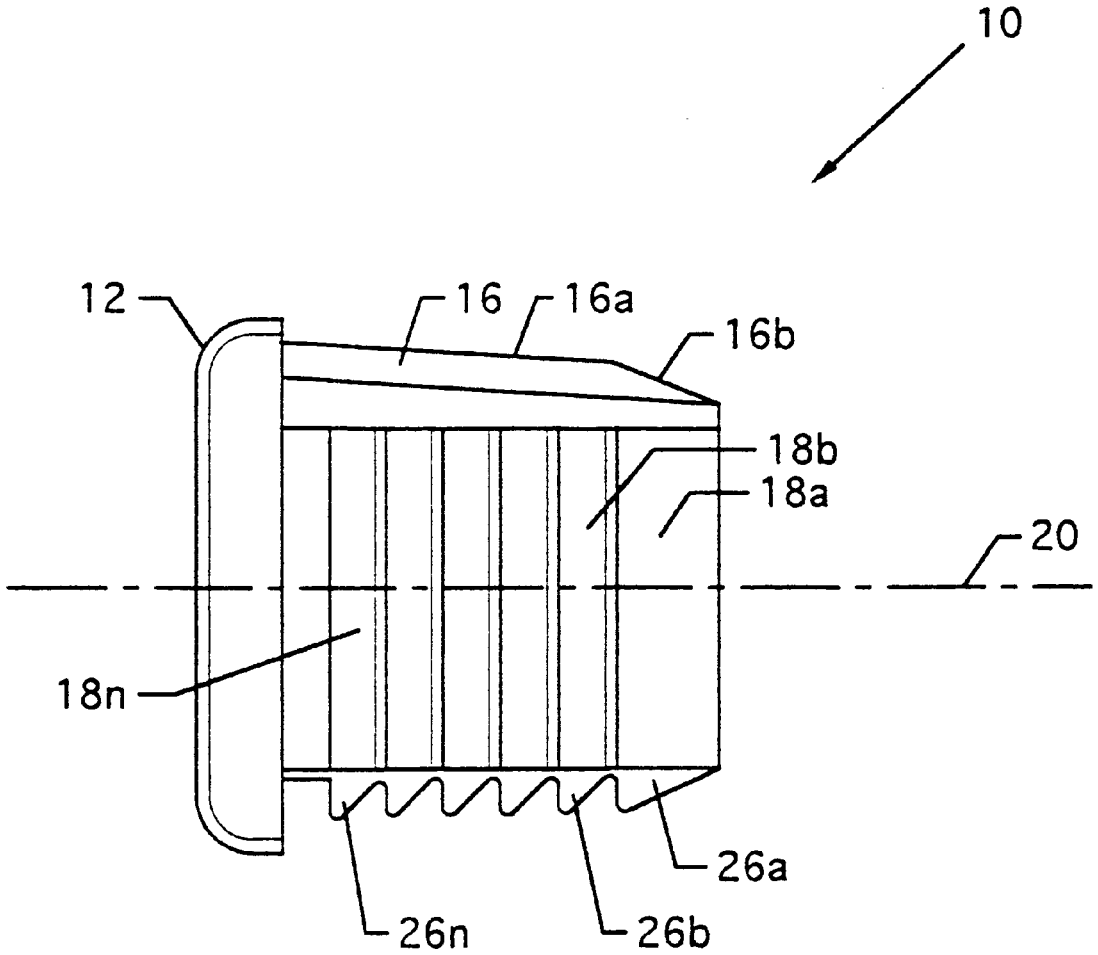
FIG. 3 illustrates a top view of the plug.
Figure 4:
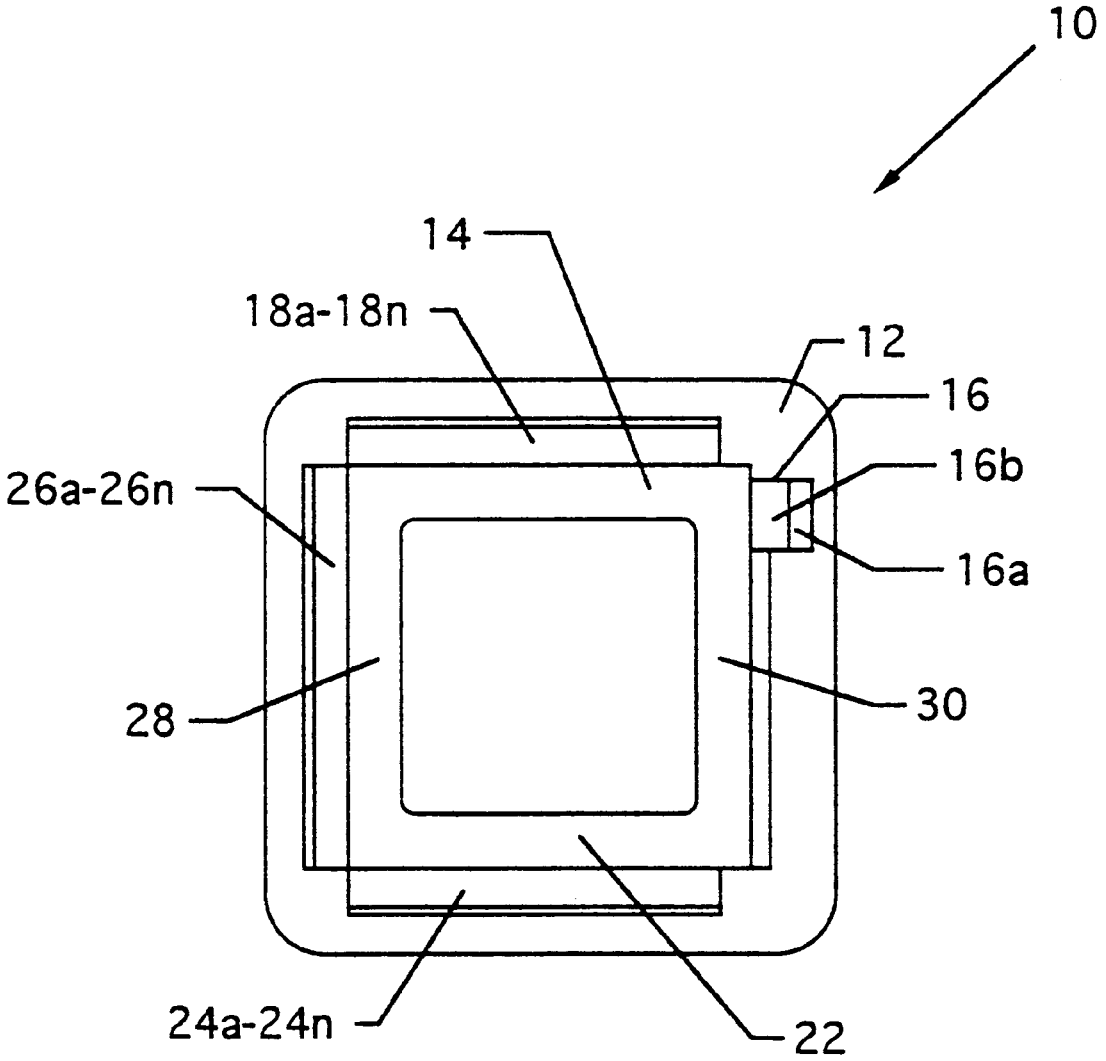
FIG. 4 illustrates an end view of the plug.

FIG. 1 illustrates an isometric view of a one-piece plug 10, such as is used to seal off or close the open ends of rails and railing support members, such as, but not limited to, square or other rectangular or other geometrically configured rails or railing support members, or other structure requiring plugging or capping. The one-piece plug 10, fashioned of plastic, rubber or other such suitable material, includes a cap 12 from which a plurality of rearwardly projecting and connected planar panels extend. An upper planar panel 14 extends horizontally and rearwardly from the cap 12 and includes a horizontally aligned tapered indexing guide bar 16 having a first tapered edge 16*a* which is widest near the junction of the cap 12 and the first tapered edge 16*a* and narrowest near a second tapered edge 16*b* located at the inboard end of the plug 10. With respect to the centerline 20 of the plug 10, the taper of the second tapered edge 16*b* exceeds that of the first tapered edge 16*a* so that the second tapered edge 16*b* serves as an alignment enhancing surface for facilitating insertion of the plug 10 into open rail or railing support member ends, while the first tapered edge 16*a* serves as an alignment surface for deeper rail or railing support member penetration. With reference to FIGS. 1, 2 and 3, an outwardly protruding array of ramped teeth 18*a*–18*n* is located on the upper portion of the upper planar panel 14. The angle or pitch of tooth 18*a* with respect to the plug centerline 20 is shallower than that of teeth 18*b*–18*n* to generally replicate the same angle as presented by the second tapered edge 16*b* to aid in initial location and insertion of the plug 10 into an open rail or railing support member end. The angle or pitch of teeth 18*b*–18*n* with respect to the centerline 20 of the plug 10 is greater than that angle or pitch presented by tooth 18*a*. As illustrated in FIGS. 2 and 4, a similarly fashioned lower planar panel 22 extends horizontally and rearwardly from the cap 12; however, a lower indexing guide bar is not included. An outwardly protruding array of ramped teeth 24*a*–24*n* is located on the lower portion of the lower planar panel 22. The angle or pitch of tooth 24*a* with respect to the plug centerline 20 is shallower than that of teeth 24*b*–24*n* to generally replicate the same angle as presented by the second tapered edge 16*b* and tooth 18*a* to aid in initial location and insertion of the plug 10 into an open rail or railing support member end. The angle or pitch of teeth 24*b*–24*n* with respect to the centerline 20 of the plug 10 is greater than that angle or pitch presented by tooth 24*a*. Another outwardly protruding array of ramped teeth 26*a*–26*n*, having the same attributes and construction as the arrays of ramped teeth 18*a*–18*n* and 24*a*–24*n*, is located on the left side planar panel 28, which extends between the upper and lower planar panels 14 and 22 and vertically and rearwardly from the cap 12. Right side planar panel 30 extends between the upper and lower planar panels 14 and 22 and vertically and rearwardly from the cap 12, but does not include an array of ramped teeth. The body of the plug along the centerline can be a partially hollow interior 21 to reduce the content of polymer material or can be solid.

Figure 5:
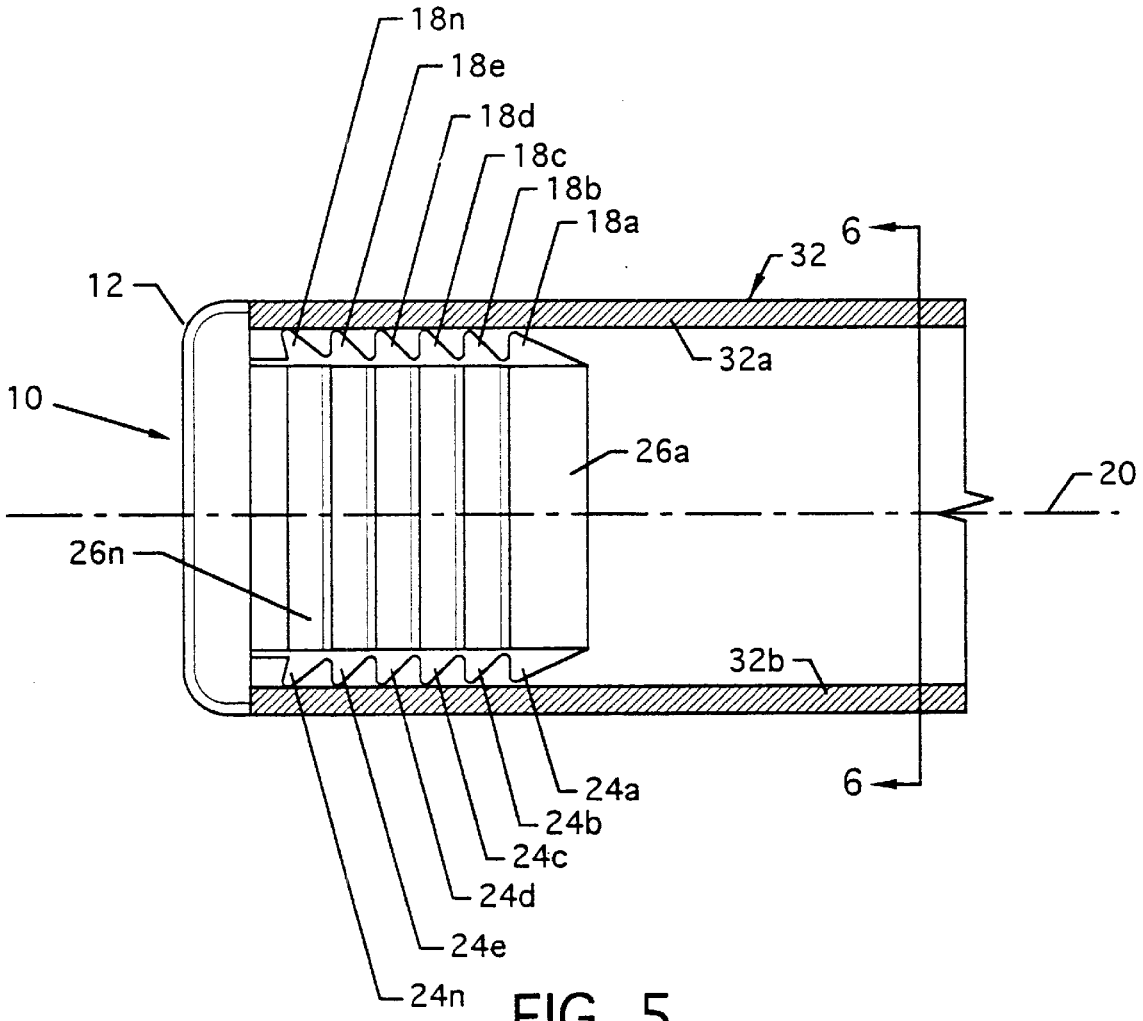
FIG. 5 illustrates a side view of the plug in frictional engagement with a rail or railing support member which is shown partially and in cross section; and, FIG. 6 illustrates an end view of the plug within the rail or railing support member looking in the direction of line 6—6 in FIG. 5.

FIG. 2 illustrates a side view of the plug 10, where all numerals correspond to those elements previously described. Illustrated in particular is the arrangement of the opposing arrays of ramped teeth 18*a*–18*n* and 24*a*–24*n* and the array of ramped teeth 26*a*–26*n* which engage the interior of a rail or railing support member as shown in FIG. 5. With respect to the horizontally aligned upper planar panel 14 and the centerline 20 of the plug 10, it can be seen that, starting from the right side of the plug 10, the height of the teeth 18*a*–18*n* increases incrementally in a ramped fashion from right to left, having a maximum tooth height nearest the cap 12. The ramping of the teeth 18*a*–18*n* allows for accommodational frictional engagement with various inside dimensions of rails or railing support members. The teeth 18*a*–18*n*, being narrower at the outer teeth tip areas, flex during frictional engagement and flex in increasing degrees along the plurality of teeth 18*a*–18*n* to firmly engage the interior of a rail or a railing support member. A number of adjacent teeth in the plurality of teeth 18*a*–18*n* progressively and in unison with opposing and adjacent like teeth 24*a*–24*n* and 26*a*–26*n* grip the interior of the rail or railing support member in wedge-like fashion.

FIG. 3 illustrates a top view of the plug 10, where all numerals correspond to those elements previously described. Illustrated in particular are the first and second tapered edges 16*a* and 16*b* of the indexing guide bar 16. The taper of the second tapered edge 16*b* exceeds that of the first tapered edge 16*a* so that the second tapered edge 16*b* serves as an alignment enhancing surface for facilitating location and insertion of the plug 10 into the open rail or railing support member end, while the first tapered edge 16*a* serves as an alignment surface for deeper rail or railing support member penetration.

FIG. 4 illustrates an end view of the plug 10, where all numerals correspond to those elements previously described.

FIG. 5 illustrates a side view of plug 10 in frictional engagement with a rail or railing support member 32 which is shown partially and in cross section, where all numerals mentioned before correspond to those elements previously described. The rail or railing support member 32 is shown in frictional engagement with teeth 18*d*–18*n* on the upper region of the plug 10 and in frictional engagement with teeth 24*d*–24*d* on the lower region of the plug 10. Teeth 18*n* and 24*n*, having the greatest offset from the centerline 20 of the plug 10, are in flexed impingement with the interior surfaces of the walls 32*a* and 32*b*, respectively, of the rail or railing support member 32. Teeth 18*e*, 18*d* and 18*c* and teeth 24*e*, 24*d* and 24*c* tangentially impinge the interior surfaces of the walls 32*a* and 32*b*, respectively, of the rail or railing support member 32 in concert with teeth 18*n* and 24*n* and in combination to frictionally engage and secure the plug 10 to the interior of the rail or railing support member 32. From right to left, each of the impinging teeth increasingly engages the interior surfaces of walls 32*a* and 32*b* of the rail or railing support member 32 in frictional engagement. It can be seen that a rail or railing support member having a thicker wall thickness would additionally engage an increased number of teeth, such as teeth 18*b* and 18*a* and teeth 24*b* and 24*a*, for purposes of illustration, whereby engagement and flexing of an increased number of teeth would occur and increase the holding power via increased frictional engagement. Teeth 26*a*–26*n* engage the interior surface of another wall (see FIG. 6 at 32*c*) of the rail or railing support member 32 in a similar fashion. The plug 10 is inserted into the end of the rail or railing support member 32 until the cap 12 comes in contact with the end of the rail or railing support member 32. Thus, the plug 10 is incorporated into the end of rail or railing support member 32 to seal the end to prevent entry of fingers as well as other objects such as dirt, insects, moisture and the like.

Figure 6:
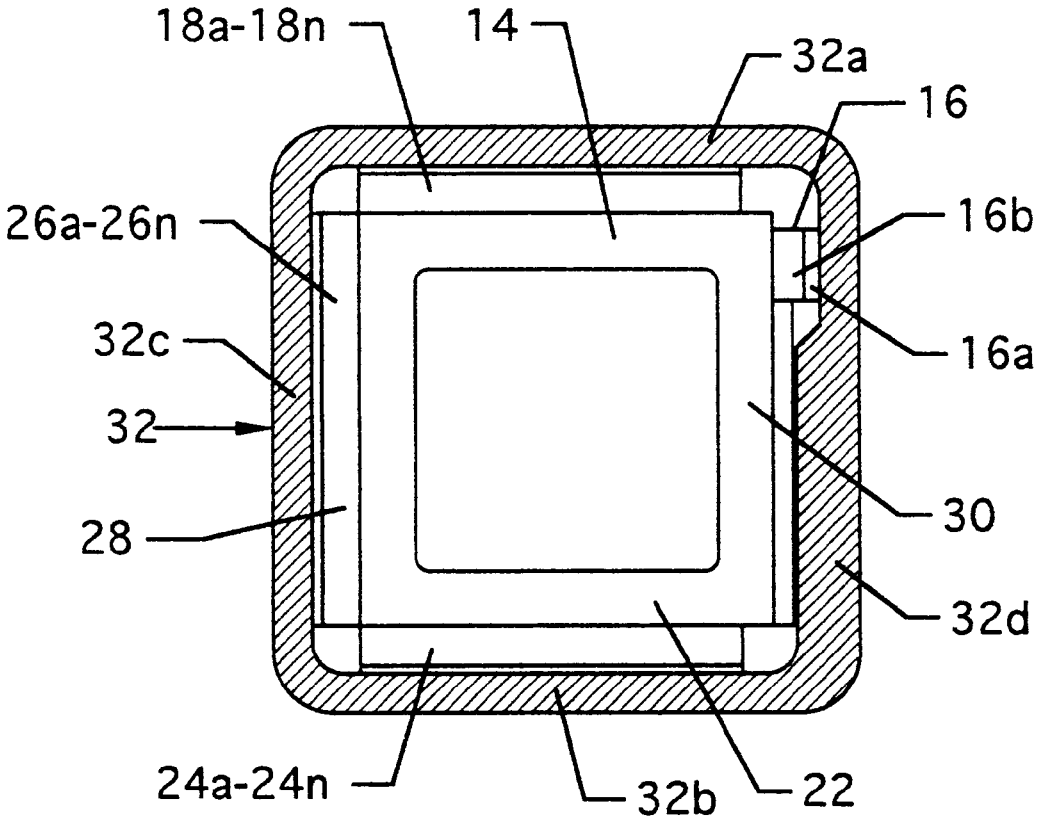

FIG. 6 illustrates an end view of the plug 10 within the rail or railing support member 32 looking in the direction of the line 6—6 in FIG. 5, where all numerals mentioned before correspond to those elements previously described. Illustrated in particular are the walls 32*a*, 32*b* and 32*c* of the rail or railing support member 32 against the interior surfaces of which the respective arrays of ramped teeth 18*a*–18*n*, 24*a*–24*n* and 26*a*–26*n* impinge. Also shown is wall 32*d* of the rail or railing support member 32. Although the wall 32*d* can be of uniform thickness throughout, like the walls 32*a*, 32*b* and 32*c*, it is illustrated as having a portion of increased thickness, such as is typical of ordinary rails or railing support members commonly used on boats, such as, but not limited to, a pontoon boat. The tapered indexing guide bar 16 engages the interior surface of wall 32*d* in the area of lesser thickness and further aids in securing the plug 10 within the open end of the rail or railing support member 32. The different thickness portions of the wall 32*d* are sometimes characterized as separate walls. Therefore, a rail or rail support member of this ordinary and well-known construction is oftentimes referred to in the art as a five-wall rail or a five-wall tube.

Although the plug 10 is illustrated and described as being generally square in shape, the plug 10 could take on rectangular shapes other than square, could be other polygonal shapes, or could even have a geometrical shape other than polygonal for use with rails or railing support members having correspondingly shaped interiors. Also, although the plug 10 is shown as having a hollow form, it could be of solid construction. Still further, the end of the cap 12 can be substantially flat, as illustrated, or can have a rounded form. Hence, neither the precise shape nor the exact form of the plug as illustrated in the drawings shall be deemed to be limiting to the scope of the invention.

Various modifications can be made to the present invention without departing from the apparent scope hereof.

It is claimed:

1. A plug for capping or sealing an open end of a tubular rail or other tubular member, comprising:

a. cap having a front side and a rear side;

b. a body portion extending substantially perpendicularly to said cap and having a first end united to said rear side of said cap and a second end remote from said rear side of said cap, said body portion including a planar upper surface, a planar lower surface, a planar first side surface, and a planar second side surface;

c. a first array of ramped teeth protruding outwardly from said upper surface; and, d. a second array of ramped teeth protruding outwardly from said lower surface;

e. a third array of ramped teeth protruding outwardly from said first side surface;

f. an indexing guide bar protruding outwardly from said second side surface and extending along the length of said body portion from said first end of said body portion to said second end of said body portion, said indexing guide bar having an outer edge which tapers inwardly toward said second side surface from said first end of said body portion to said second end of said body portion.

2. A plug as defined in claim 1, wherein each ramped tooth of said first array of ramped teeth has a tip and a portion which slopes from the tip toward said upper surface in the direction of said second end of said body portion, and each ramped tooth of said second array of ramped teeth has a tip and a portion which slopes from the tip toward said lower surface in the direction of said second end of said body portion.

3. A plug as defined in claim 2, wherein each ramped tooth of said first array of ramped teeth has a height defined by the distance from said upper surface to its tip and wherein said heights progressively increase from said second end of said body portion to said first end of said body portion, and wherein each ramped tooth of said second array of ramped teeth has a height defined by the distance from said lower surface to its tip and wherein said heights progressively increase from said second end of said body portion to said first end of said body portion.

4. A plug as defined in claim 3, wherein the dimensions of said cap are such that the periphery of said cap lies beyond said tips of said ramped teeth of said first and second arrays of ramped teeth and beyond said first and second side surfaces.

5. A plug as defined in claim 1, wherein said upper and lower surfaces form right angle corners with said first and second side surfaces.

6. A plug as defined in claim 1, wherein said cap, said body portion, said first array of ramped teeth, and said second array of ramped teeth all constitute a one-piece, unitary member.

7. A plug as defined in claim 1, wherein said body portion has a hollow area which extends from said second end of said body portion toward said first end of said body portion.

8. A plug as defined in claim 1, wherein said outer edge of said indexing guide bar tapers at a first angle from said first end of said body portion to a point intermediate said first and second ends of said body portion, and at a second angle, steeper than said first angle, from said point to said second end of said body portion.

9. A plug as defined in claim 1, wherein said ramped teeth of each of said first, second and third arrays of ramped teeth progressively increase in height from the respective upper, lower and first side surfaces from which they protrude in the direction from said second end of said body portion to said first end of said body portion.

10. A plug as defined in claim 9, wherein all of said ramped teeth of each of said first, second and third arrays of ramped teeth are flexible.

11. A plug as defined in claim 1, wherein said upper and lower surfaces form right angle corners with said first and second side surfaces, and wherein said indexing guide bar is located on said second side surface immediately adjacent to the right angle corner formed between said upper surface and said second side surface.

12. A plug as defined in claim 1, wherein said cap, said body portion, said first, second and third arrays of ramped teeth, and said indexing guide bar all constitute a one-piece, unitary member.

13. A plug for capping or sealing an open end of a tubular rail or other tubular member, comprising:

a. a cap having a front side and a rear side;

b. an upper panel, a lower panel, a first side panel, and a second side panel each extending substantially perpendicularly to said rear side of said cap and united to said rear side of said cap, said panels being joined to each other at right angle corners and each of said panels having an outer surface and an inner surface, said inner surfaces being spaced from each other and bounding a hollow area; and, c. a first array of ramped teeth protruding outwardly from the outer surface of said upper panel, a second array of ramped teeth protruding outwardly from the outer surface of said lower panel, and a third array of ramped teeth protruding outwardly from the outer surface of said first side panel;

d. an indexing guide bar protruding outwardly from the outer surface of said second side panel immediately adjacent to the right angle corner formed between said upper panel and said second side panel and extending alone the length of said second side panel, said indexing guide bar having an outer edge which tapers inwardly toward said outer surface of said second side panel in the direction away from said rear side of said cap.

14. A plug as defined in claim 13, wherein said ramped teeth of each of said first, second and third arrays of ramped teeth progressively increase in height from the respective outer surfaces from which they protrude from a minimum height remote from said cap to a maximum height adjacent to said cap.

15. A plug as defined in claim 14, wherein each one of said ramped teeth of said first, second and third arrays of ramped teeth has a flexible tip.

16. A plug as defined in claim 15, wherein said cap, said upper panel, said lower panel, said first side panel, said second side panel, said first, second and third arrays of ramped teeth, and said indexing guide bar all constitute a one-piece, unitary member.

* * * * *